US012774126B2

(12) United States Patent
Dixon-Garrett et al.

(10) Patent No.: US 12,774,126 B2
(45) **Date of Patent: *Oct. 27, 2026**

(54) CONTAINER CONSTRUCTION WITH FLEXIBLE LINER AND ONE-WAY VALVE

(71) Applicant: Sonoco Development, Inc., Hartsville, SC (US)

(72) Inventors: Sabrina V. Dixon-Garrett, Bennettsville, SC (US); Lawrence Robert Carpenter, Darlington, SC (US)

(73) Assignee: Sonoco Development, Inc., Hartsville, SC (US)

( * ) Notice: Subject to any disclaimer, the term of this patent is extended or adjusted under 35 U.S.C. 154(b) by 4 days.

This patent is subject to a terminal disclaimer.

(21) Appl. No.: 18/941,084

(22) Filed: Nov. 8, 2024

(65) Prior Publication Data

US 2025/0066063 A1 Feb. 27, 2025

Related U.S. Application Data

(63) Continuation of application No. 18/198,028, filed on May 16, 2023, now Pat. No. 12,145,771, which is a (Continued)

(51) Int. Cl.
*B65D 3/26* (2006.01)
*B65D 3/04* (2006.01)
(Continued)

(52) U.S. Cl.
CPC ..... *B65D 3/268* (2013.01); *B65D 3/04* (2013.01); *B65D 17/502* (2013.01); *B65D 51/20* (2013.01); *B65D 2577/205* (2013.01)

(58) Field of Classification Search
CPC ..... B65D 2251/0093; B65D 2205/00; B65D 33/01; B65D 51/16; B65D 51/165; B65D 83/0061
See application file for complete search history.

(56) References Cited

U.S. PATENT DOCUMENTS 3,580,468 A 5/1971 McDevitt
3,682,355 A 8/1972 Lo
(Continued)

FOREIGN PATENT DOCUMENTS

EP 0949152 A1 10/1999
EP 1350738 A1 10/2003
(Continued)

OTHER PUBLICATIONS

International Preliminary Report of Patentability with Written Opinion of International application No. PCT/US2020/041002 dated Jan. 20, 2022; 8 pages.

*Primary Examiner* — Shawn M Braden
(74) *Attorney, Agent, or Firm* — Nelson Mullins Riley & Scarborough LLP

(57) ABSTRACT

In an embodiment, the invention comprises a container comprising: a base; at least one sidewall extending upwardly from the base and terminating in a top edge, wherein the at least one sidewall is paper-based; a removable flexible membrane adhered to the top edge, wherein the membrane comprises a one-way valve; a liner ply at least partially adhered to an interior surface of the sidewall, wherein the liner ply is configured to at least partially release from the sidewall upon a pressure differential between the pressure within the container and the external pressure.

18 Claims, 6 Drawing Sheets

Related U.S. Application Data continuation of application No. 16/922,212, filed on Jul. 7, 2020, now Pat. No. 11,691,777.

(60) Provisional application No. 62/871,431, filed on Jul. 8, 2019.

(51) Int. Cl.
*B65D 17/50* (2006.01)
*B65D 51/20* (2006.01)

(56) References Cited

U.S. PATENT DOCUMENTS

| | | | | |
|---|---|---|---|---|
| 4,295,840 | A | 10/1981 | Sansbury | |
| 5,584,409 | A | 12/1996 | Chemberlen | |
| 5,988,493 | A | 11/1999 | Clougherty | |
| 6,510,674 | B1 | 1/2003 | Case | |
| 6,733,803 | B1 | 5/2004 | Vidkjaer | |
| 6,739,500 | B1 * | 5/2004 | Gentile | B65D 25/16 206/524.8 |
| 7,131,550 | B2 | 11/2006 | Montserrat et al. | |
| 7,828,197 | B2 | 11/2010 | Schuetz | |
| 8,434,637 | B2 | 5/2013 | Kozo et al. | |
| 9,573,747 | B2 | 2/2017 | Koland et al. | |
| 10,081,475 | B2 | 9/2018 | Buisson et al. | |
| 2002/0003143 | A1 | 1/2002 | Grayer | |
| 2003/0038170 | A1 | 2/2003 | Case | |
| 2003/0178429 | A1 * | 9/2003 | Williams | B65D 81/2015 220/495.03 |
| 2007/0283136 | A1 | 12/2007 | Hsieh | |
| 2009/0212071 | A1 | 8/2009 | Tom et al. | |
| 2013/0161349 | A1 | 6/2013 | Pfeiffenberger | |
| 2016/0009447 | A1 * | 1/2016 | Rhue | B65D 3/22 493/52 |
| 2017/0283136 | A1 * | 10/2017 | Branyon | B32B 27/306 |
| 2021/0101723 | A1 | 4/2021 | Choi | |

FOREIGN PATENT DOCUMENTS

| | | | |
|---|---|---|---|
| EP | 1882637 | A1 | 1/2008 |
| EP | 3095600 | A1 | 11/2016 |
| FR | 2791037 | A1 | 9/2000 |

* cited by examiner

CONTAINER CONSTRUCTION WITH FLEXIBLE LINER AND ONE-WAY VALVE

CROSS-REFERENCE TO RELATED APPLICATIONS

This application is a continuation of U.S. patent application Ser. No. 18/198,028, filed May 16, 2023, which is a continuation of U.S. patent application Ser. No. 16/922,212, filed Jul. 7, 2020, now U.S. Pat. No. 11,691,777, entitled "CONTAINER CONSTRUCTION WITH FLEXIBLE LINER AND ONE-WAY VALVE", that claims priority to Provisional Application No. 62/871,431, filed Jul. 8, 2019, all of which are incorporated herein in their entirety.

FIELD OF THE INVENTION

The present invention relates to containers having a flexible liner disposed within the interior of the container and a membrane valve disposed on a flexible membrane which closes the container.

BACKGROUND OF THE INVENTION

Food and drink products and other perishable items are often packaged in sealed composite containers. In some cases, these may be rigid or semi-rigid paper containers such as those are often used to store foodstuffs such as, but not limited to, potato chips, peanuts, candies, cookies, wafers, and/or crackers. In some embodiments, the container may be cylindrical. The bottom end of the container may comprise a sealed paper bottom and the top end of the container may be sealed with a flexible membrane.

When a container is sealed, its internal pressure will be equal that the external atmospheric pressure. However, the container internal pressure and the external atmospheric pressure may vary during, for example, shipping to higher or lower altitude locations. As altitude increases, atmospheric pressure decreases, and vice versa. For example, at an altitude of 500 feet, atmospheric pressure is approximately 14.4 PSI. However, at an altitude of 5000 feet, atmospheric pressure is approximately 12.2 PSI. Thus, transportation of a sealed container to a higher altitude may result in negative pressure (lower internal pressure than external pressure) and transportation of a sealed container to a lower altitude may result in positive pressure (higher internal pressure than external pressure).

In containers, positive pressure may cause bulging, failed heat seals, exploded/distended container sidewalls, or extended/distended paper bottoms. Negative pressure (vacuum effect) may cause internal distortion, failed heat seals, imploded container sidewalls, or imploded paper bottoms. The present invention provides a container which minimizes and, in some cases, avoids package distortion due to internal and/or external pressure changes.

SUMMARY OF THE INVENTION

The present invention relates to containers having a flexible liner disposed within the interior of the container and a membrane valve disposed on a flexible membrane which closes the container.

In an embodiment, the invention comprises a container comprising: a base; at least one sidewall extending upwardly from the base and terminating in a top edge, wherein the at least one sidewall is paper-based; a removable flexible membrane adhered to the top edge, wherein the membrane comprises a one-way valve; and a liner ply at least partially adhered to an interior surface of the sidewall, wherein the liner ply is configured to at least partially release from the sidewall upon a pressure differential between the pressure within the container and the external pressure.

In an embodiment, the container sidewall comprises a composite material. In an embodiment, the container is rigid. In an embodiment, the container comprises spiral-wound paperboard. In an embodiment, the liner ply comprises a polymeric material. In an embodiment, the liner ply has barrier properties. In an embodiment, the adhesive comprises a dextrin-based adhesive. In an embodiment, the adhesive is flood coated between the liner ply and the sidewall. In an embodiment, the adhesive comprises a resealable adhesive.

In another embodiment, the invention comprises a container comprising: a base; at least one sidewall extending upwardly from the base and terminating in a top edge, wherein the at least one sidewall is paper-based; a removable flexible membrane adhered to the top edge, wherein the membrane comprises a one-way valve; and a liner ply pattern adhered to an interior surface of the sidewall, wherein the liner ply is configured to flex, in the unadhered areas, toward and away from the sidewall upon a pressure differential between the pressure within the container and the external pressure.

In an embodiment, the adhesive pattern comprises diagonal adhesive strips. In an embodiment, the container comprises spiral-wound paperboard and the diagonal adhesive strips follow the spiral-wound pattern. In an embodiment, the adhesive comprises a polyvinyl acetate-based adhesive. In an embodiment, the valve is integrally formed with the top membrane. In an embodiment, the valve is externally applied to the top membrane.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

Figure 1:
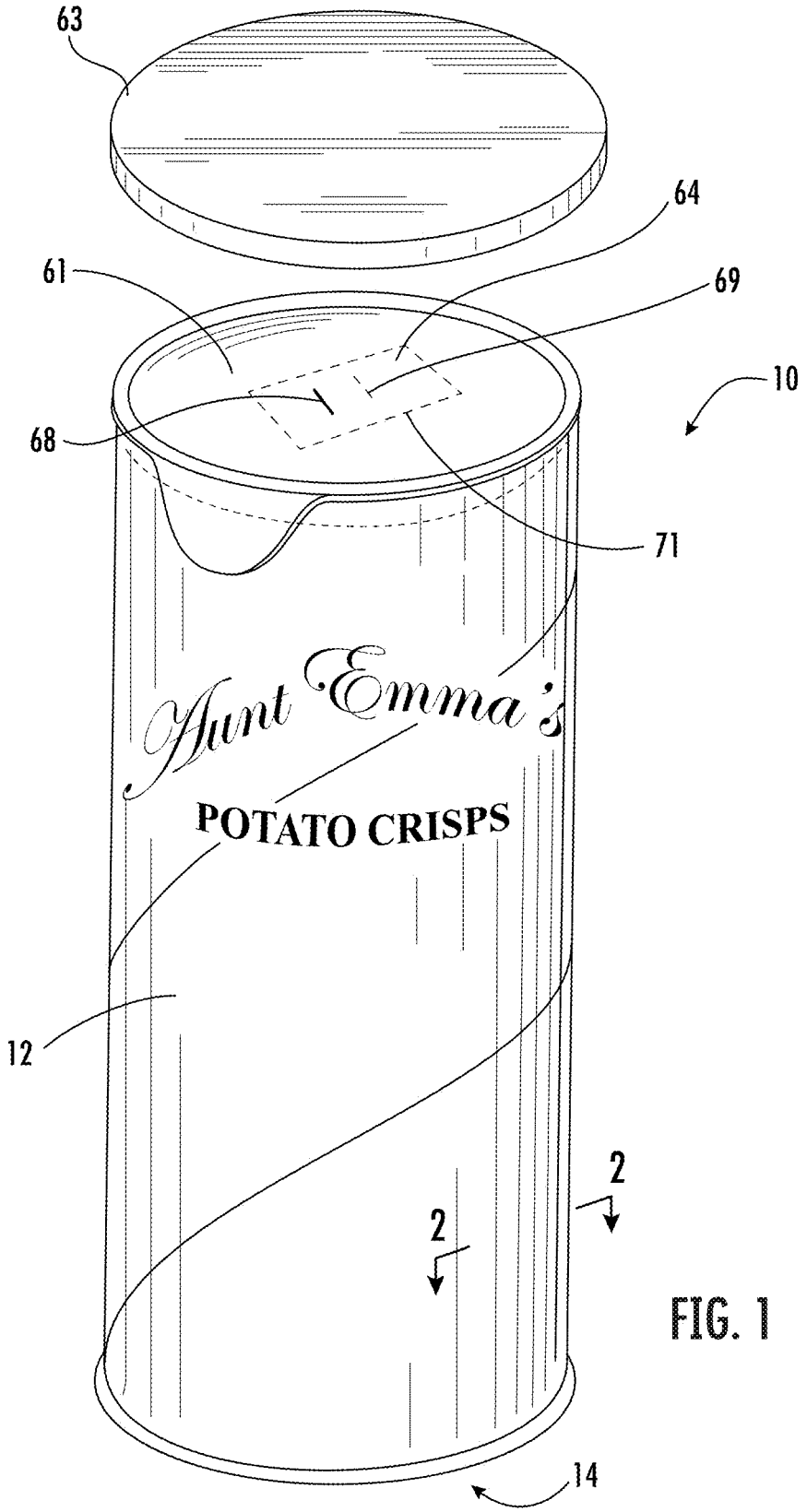
FIG. 1 is a perspective view of a container structure of the invention.
Figure 2:
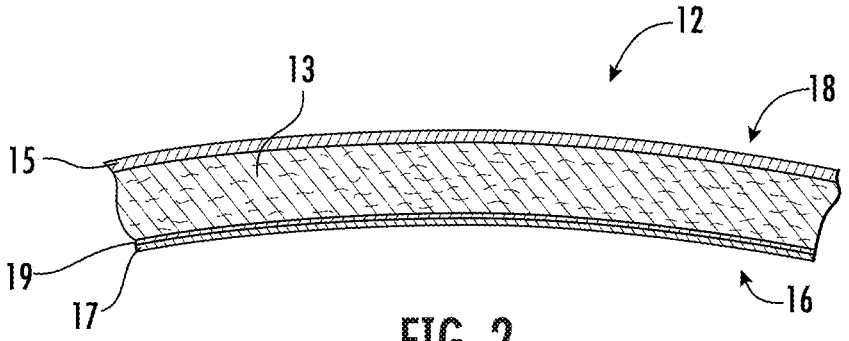
FIG. 2 is a cross-sectional view of a container sidewall of the invention as seen along lines 2-2 of FIG. 1.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Terms of reference such as "top," "bottom," or "side" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

Turning to the figures, a container 10 is illustrated. Although illustrated as a tube having a circular cross section, the body of the container 10 may have any cross-sectional shape known in the art. For example, the container 10 may have the general configuration of a rectangle or square, optionally with rounded corners. Likewise, the cross-section of the container may be generally triangular or have a higher order polygonal profile or irregular shape. The container may have an elliptical or ovular general shape in other embodiments. In an embodiment, the container is configured to stand stably upright on a surface.

The container 10 includes at least one vertical body wall which may be considered the sidewall 12. The container 10 may also comprise a bottom wall 14. In an embodiment, the container 10 is cylindrical or tubular. In this embodiment, the bottom wall 14 may be generally circular. In another embodiment, the container 10 may comprise multiple vertical body walls, such as four body walls, which may each be considered side walls or may be considered a front wall, a back wall, and two side walls. In this embodiment, the bottom wall may be generally square or rectangular. In an embodiment, the at least one sidewall 12 extends upwardly from the bottom wall 14. In an embodiment, the container 10 is rigid, semi-rigid, or substantially inflexible.

The at least one sidewall 12 of the container may be composed of spiral-wound paperboard, cardboard, or any other paper-based product, in an embodiment. In another embodiment, the sidewall 12 may comprise another type of material, such as a molded plastic. Any material known in the art may be used in this embodiment. In an embodiment, the container sidewall 12 may include a barrier layer that serves as a barrier to the passage of liquids and/or gasses such as oxygen.

In an embodiment, the sidewall 12 has an inner surface 16 which extends around an open interior 20 of the container. The container sidewall 12 also has an outer surface 18 which forms the exterior of the container. The open interior 20 houses products, such as food products 22, in an embodiment. While the container is well-suited for containment of food products, it should be understood that the container can be utilized for any product that would benefit from a hermetic seal. The container is particularly well-suited for any hermetically sealed container which will be exposed to or may experience changes in atmospheric pressure.

In an embodiment, the container sidewall 12 comprises a single ply which may be a body ply 13, optionally composed of spiral-wound paperboard having a thickness of about 0.15-0.30 inch. In another embodiment, the container sidewall 12 is multi-ply.

In one embodiment, a label ply 15 may be adhered to the outer surface of body ply 13. The label ply 15 may be constructed from any material known in the art, such as kraft paper, optionally in combination with various polymers or the like. In another embodiment, the label ply 15 may comprise a polymeric film. In certain embodiments, the label ply 15 may be multi-layered or may be metalized. The label ply 15 may be inkjet printed and may convey graphics, product information, nutritional information, instructions, and/or regulatory compliance information. In other embodiments, any printed information may be integral with the body ply 13 and/or printed directly thereon.

In an embodiment, the container 10 comprises a liner ply 17 at least partially adhered to the interior surface of the body ply 13. In an embodiment, an adhesive layer 19 is disposed between the liner ply 17 and the body ply 13.

The liner ply 17 may comprise a polymeric material or any other material known in the art. In an embodiment, the liner ply 17 comprises a polyethylene film. The liner ply 17 may be flexible, resilient, stretchable, and/or airtight. The liner ply 17 may be impermeable to liquids and gases. The liner ply 17 may be single ply or constructed of multiple layers (multi-ply). The liner ply 17 may comprise layers of kraft paper, a polymeric material, and a foil layer, or any combination thereof, in an embodiment. The liner ply 17 may have barrier properties.

In an embodiment, the liner ply 17 is adhered to the body ply 13 using an adhesive layer 19. The adhesive layer 19 may, in an embodiment, be a releasable adhesive. The adhesive layer 19, in an embodiment, is flood coated over the surface of the liner ply 17 and/or the body ply 13. In this embodiment, the adhesive may have 100% coverage or nearly 100% coverage between the liner ply 17 and the body ply 13. In this embodiment, the adhesive layer 19 may comprise a weak adhesive, such as a corn starch-based or dextrin-based adhesive, a pressure-sensitive adhesive, or any other adhesive that has a limited adhesion. In an embodiment, the adhesive layer 19 may comprise a cohesive. In this embodiment, the weak adhesive may allow the liner ply 17 to at least partially separate from the body ply 13 upon a pressure differential between the pressure within the container and the external pressure (i.e. a movement from a lower elevation to a higher elevation, causing negative pressure).

In an embodiment, the adhesive maintains its adhesion along the sidewall 12 nearest the container ends. For example, the liner ply 17 may continuously remain adhered to the sidewall 12 nearest the top end (optionally, on or near rolled edge 32) and bottom end 14 of the cylindrical container, regardless of internal and external pressures. In an embodiment, the liner ply 17 is rolled into the rolled edge 32 and/or the seam at the bottom end 14 of the cylindrical container.

In an embodiment, a substantial portion of the liner ply 17 may separate from the body ply 13 upon a pressure differential between the pressure within the container and the external pressure. In another embodiment, at least 50% of the liner ply 17 may separate from the body ply 13 upon a pressure differential between the pressure within the container and the external pressure. In yet another embodiment, at least 75% of the liner ply 17 may separate from the body ply 13 upon a pressure differential between the pressure within the container and the external pressure. In an embodiment, the separation between the liner ply 17 and the body ply 13 occurs primarily near the midsection of the container body, between the top and bottom ends.

In an embodiment, the adhesive is a resealable adhesive, such as a pressure sensitive adhesive, which allows the liner ply 17 to at least partially re-adhere to the body ply 13 upon a pressure differential between the container 10 internal and external pressures (i.e. a movement from a higher elevation to a lower elevation, causing positive pressure). Thus, in this embodiment, the liner ply 17 may repeatedly release from and reseal to the body ply 13 as pressure differentials occur. In an embodiment, the inventive container is effective across a pressure differential of between about 4 inches mercury and about 10 inches mercury.

Figure 3:
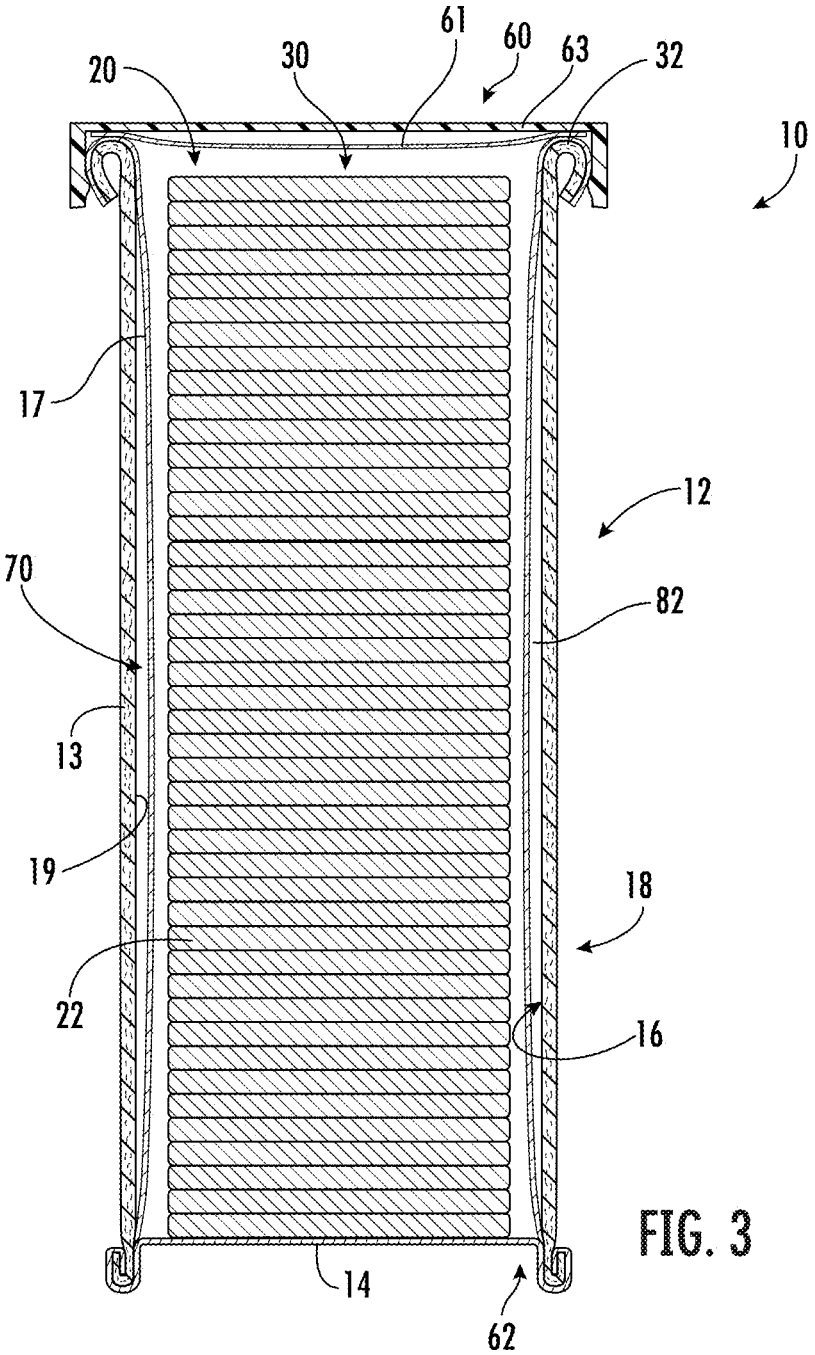
FIG. 3 is a cross-sectional view of a container structure in an embodiment of the invention.

FIG. 3 shows a sectional view of an embodiment of the tubular container 10 wherein the liner ply 17 is substantially released from the body ply 13. More specifically, the axially opposed end portions of the liner ply 17 (near the top end and bottom end of the container) remain adhered to the inner surface of the body ply 13, but are separated by a medial portion 70 of the liner ply 17 disposed between the axially opposed end portions that is free and un-adhered to the body ply 13. Accordingly, after the food products 22 have been placed inside the cavity defined by the liner ply 17, the liner ply 17 is free to move inwardly against the food products 22 when a vacuum is created, balancing the pressure on the inner and outer surfaces of the liner ply 17. Likewise, the liner ply 17 may move outwardly away from the food products 22 when internal pressure increases.

In another example, the adhesive layer 19 may be pattern applied to either the liner ply 17 or the body ply 13 interior surface prior to application of the liner ply 17 to the body ply 13. In this embodiment, the pattern of the adhesive 50 between the liner ply 17 and the body ply 13 may comprise one or more adhesive-free regions 55 (shown in FIG. 7). In an embodiment, the pattern of the adhesive layer 19 may be repetitive, such as a plaid, horizontal, vertical or diagonal stripes, a repeating diamond, a criss-cross, or a cross-hatched pattern. In an embodiment, the pattern may comprise diagonal lines which follow the spiral patter of a spirally-wound container. Some exemplary patterns are set forth in FIG. 7A-7D, but the invention should not be limited to these patterns. Any pattern known in the art may be utilized. In some embodiments, the adhesive pattern between the liner ply 17 and body ply 13 is asymmetrical.

In the pattern adhesive embodiments, the adhesive utilized may comprise a stronger adhesive than would be used in the 100% coverage embodiment. An example of a stronger adhesive which could be used in this embodiment is a polyvinyl acetate (PVA)-based adhesive such as PVAc white glue, or any other adhesive known in the art. In this embodiment, the liner ply 17 may at least partially separate from the body ply 13 only in the adhesive-free regions 55, upon a pressure differential between the container 10 internal and external pressures. In this embodiment, the stronger adhesive may retain adhesion between the liner ply 17 and the body ply 13 in the areas where the adhesive is pattern applied, regardless of external or internal pressure differentials. That being said, the adhesive utilized in the pattern adhesive embodiments could comprise a weaker adhesive such as a dextrin-based adhesive.

Figure 4:
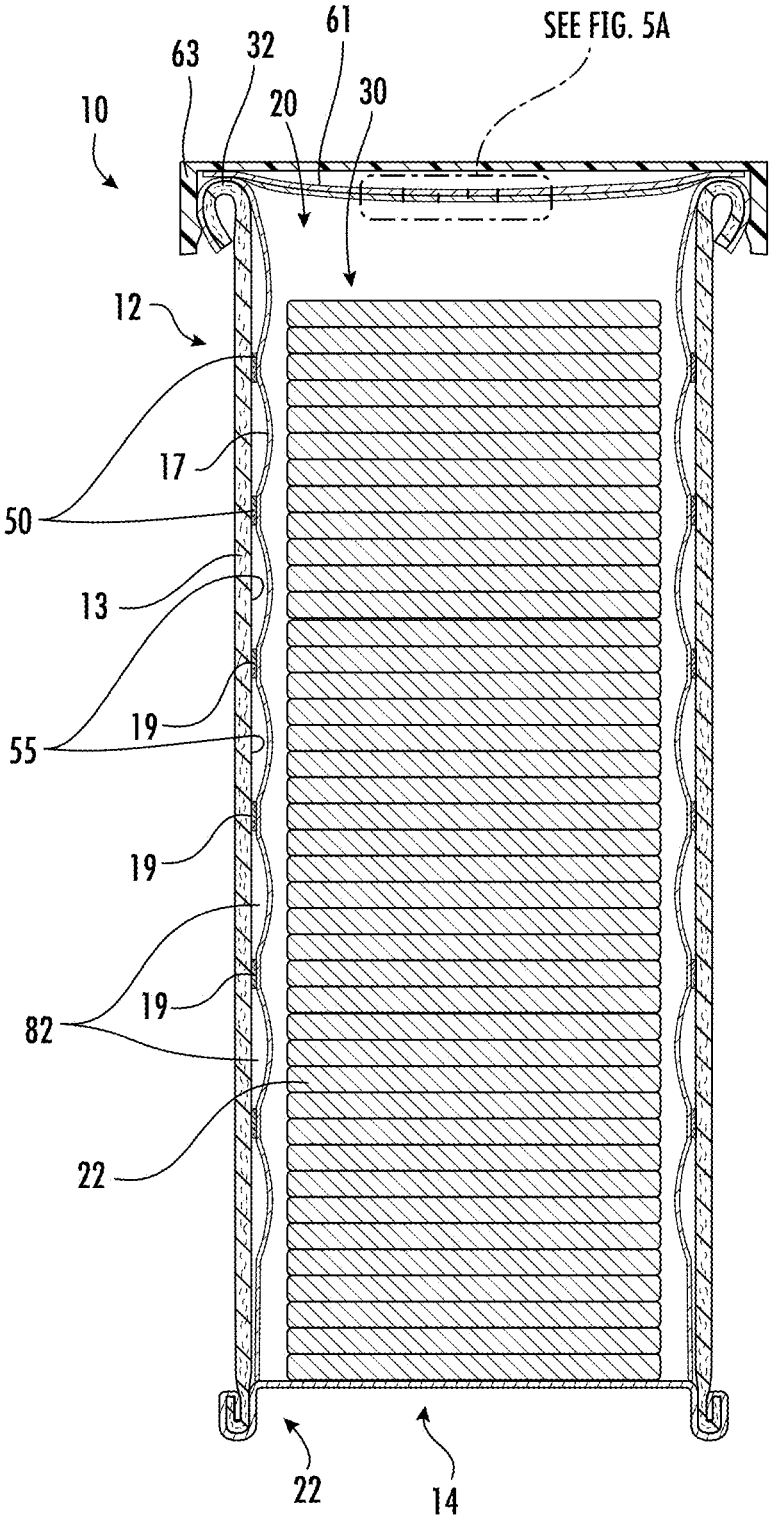
FIG. 4 is another cross-sectional view of a container structure in an embodiment of the invention.

FIG. 4 shows a sectional view of the tubular container 10 wherein the liner ply 17 is sealed with a pattern adhesive layer 19 and is released or substantially released from the body ply 13 in only the adhesive-free regions 55. In an embodiment, in addition to maintaining adhesion in the patterned adhesive regions 50, the liner ply 17 may remain adhered to the body ply 13 near the top end and bottom end of the container, as was described above. More specifically, the axially opposed end portions of the liner ply 17 remain adhered to the inner surface of the body ply 13, but are separated by a medial portion 70 of the liner ply 17 disposed between the axially opposed end portions that is free and un-adhered to the body ply 13 in the adhesive-free regions 55. Accordingly, after the food products 22 have been placed inside the cavity defined by the liner ply 17, the portions of the liner ply 17 which are in the adhesive-free regions 55 are free to move inwardly against the food products 22 when a vacuum is created, balancing the pressure on the inner and outer surfaces of the liner ply 17.

In either embodiment, if the container 10 is transported from a lower altitude to a higher altitude, the internal pressure within the container 10 may be less than atmospheric pressure, creating a vacuum on the interior of the can (negative pressure). The liner ply 17 may then at least partially detach or separate from the body ply 13, or move inwardly toward the food product 22, to adjust the internal volume of the container 10. The stress of the internal vacuum is alleviated by the reduction in volume from the liner ply 17 shape change, reducing or eliminating container implosion.

Similarly, in another example, relatively hot potato chips (crisps) could be deposited within the container 10 and then sealed by an end closure 60. Hot air may become trapped within the container 10. As the temperature of the air in the container 10 decreases, the volume of the air decreases as well. Thus, a slight vacuum or negative pressure may form within the container. The vacuum on the interior of the container 10 may introduce excessive stress to the body ply 13 of the container 10, which may result in at least partial inward bending or collapsing of the container sidewall 12 along the length of the container. This can result in an unacceptable appearance for the container 10 or an unacceptable sealing of the product 22 within the container 10 (i.e. the heat seal on one or both ends may fail or partially fail). In this scenario, the liner ply 17 may at least partially detach or separate from the body ply 13, or move inwardly toward the food products 22, to adjust the internal volume of the container 10. The stress of the internal vacuum is alleviated by the reduction in volume from the liner ply 17 shape change, reducing or eliminating container distortion, implosion and/or collapse.

In one embodiment, the liner ply 17 is adhered only to the sidewall 12 of the container 10. In another embodiment, the liner ply is adhered to the sidewall 12 and the bottom wall 14 of the container 10. In this embodiment, the liner ply 17 may have a bottom surface. The liner ply 17 may also have at least one sidewall extending upwardly from the optionally bottom surface and may comprise a flexible open-ended bag. In other embodiments, the liner ply 17 is tubular in nature, optionally extending onto the bottom wall 14 without having a bottom surface. Any liner ply 17 configuration known in the art may be useful in the invention. In an embodiment, the shape and configuration of the liner ply 17 is substantially similar to or the same as the shape and configuration of the container 10. For example, if the container 10 is cylindrical, the liner ply 17 may also be substantially cylindrical or cylindrical. The liner ply 17 may have a shape and size that permit it to be disposed in the interior of the container 10 with which it is to be used.

In one embodiment, the container sidewall 12 is open on its top end and the sidewall 12 terminates in a top edge 32 which defines the open top end 30. The top edge 32 may be a rolled edge or bead. In an embodiment, the liner ply 17 extends the entire length of the body ply 13, including over and across the top edge 32. In an embodiment, the liner ply 17 may be rolled into the construction of the bead. In this embodiment, the membrane lid 61, discussed below, may attach to the liner ply 17 over the top edge 32. In another embodiment, the liner ply 17 does not extend over the top edge 32 and may terminate just before the top edge 32. In an embodiment, the liner ply 17 extends through the curl and/or seam, affixing the bottom end wall to the container sidewall. In an embodiment, the extension of the liner ply 17 through the top edge 32 and/or bottom edge of the container aids in ensuring the adhesion of the liner ply 17 to the body ply 13.

In an embodiment, a food product 22 is stacked or stored within the container 10. In an embodiment, the food product 22 does not directly contact the inner surface 16 of the container sidewall 12 due to the interference of the liner ply 17. Byproducts from the food product (i.e. oil, grease) are thus prevented from contact with or migration into the container body ply 13. In this way, the body ply 13 can be easily recycled if the liner ply 17 is removed from its interior. Likewise, liner ply 17 can also be recycled.

In a particular embodiment, use of the liner ply 17 may avoid the need for a barrier film or barrier layer to be applied to the interior surface 16 of the container body or incorporated into the body ply 13, thereby reducing costs, manufacturing time, and improving the recyclability of the container.

In one embodiment, the tubular container 10 of the present invention includes a top end closure 60 and a bottom end closure 62. In an embodiment, the top end of the container 10 may be closed via a flexible membrane 61 that is affixed or sealed to the top edge 32 of the tubular container 10. The flexible membrane 61 may be made of a single ply or multiple plies of flexible laminate film(s), kraft paper, foil, polymers, and/or any other materials known in the art. In an embodiment, the flexible membrane 61 may be heat sealed or adhesively attached to the top end of the tubular container 10. In an embodiment, the membrane 61 includes a barrier layer that serves as a barrier to the passage of liquids and/or gasses such as oxygen. The flexible membrane 61 may be peelably removable from the container 10 in order to access to contents thereof.

In an embodiment, a one-way valve 64 is disposed within the membrane 61. In an embodiment, the valve 64 can be externally applied to the top membrane 61 after formation of the membrane or, in another embodiment, the valve 64 may be integrally formed with the top membrane 61. In the external application of a valve 64, a slit may be cut into the top membrane 61 and the valve 64 may be adhered over the slit. The externally-applied valve 64 may have a pressure sensitive (or other) adhesive disposed on its lower side and a release paper may be removed before using the PSA to adhere the valve 64 to the membrane. The valve may otherwise operate as is set forth herein.

In either embodiment, the valve 64 is in communication with the interior 20 of the container, within the interior of the liner ply 17. More specifically, the valve 64 is disposed such that the open interior of the container may release gases through the valve and to the atmosphere. In an embodiment, the valve 64 is located in the center of the membrane 61. In an embodiment, the valve 64 may be located internal of the perimeter of the liner ply 17.

Figure 5A:
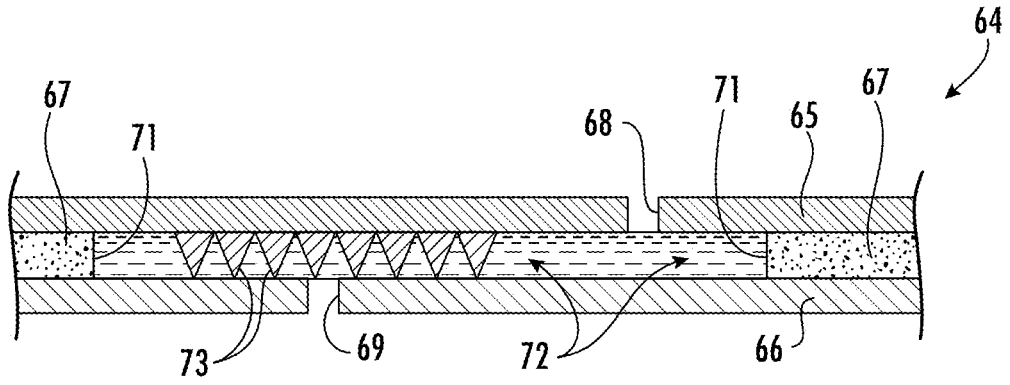
FIG. 5A is an exploded cross-sectional view of a valve structure in a closed embodiment of the invention.
Figure 5B:
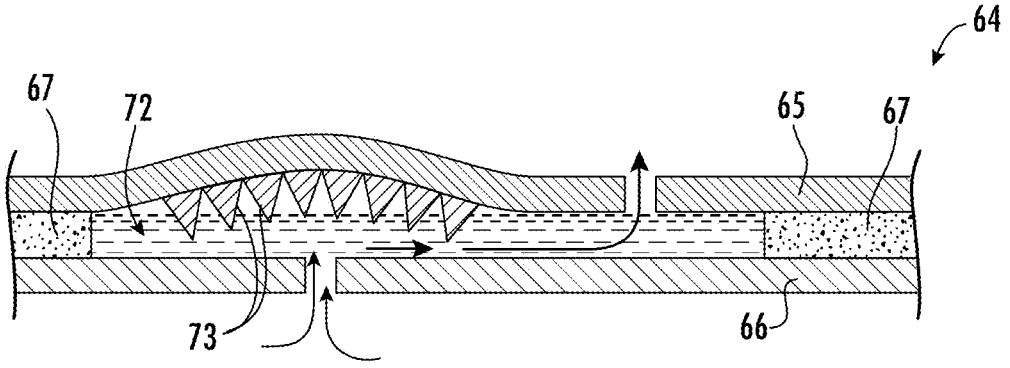
FIG. 5B is an exploded cross-sectional view of a valve structure in an open embodiment of the invention.
Figure 5C:
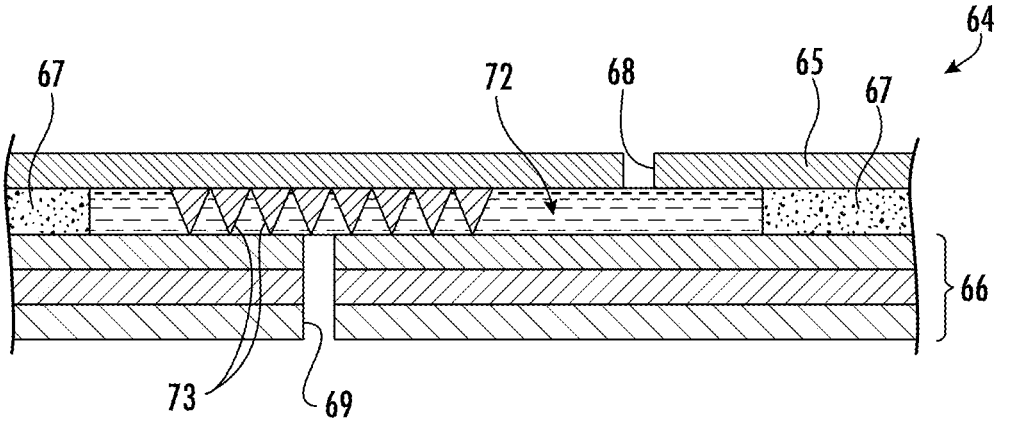
FIG. 5C is an exploded cross-sectional view of a valve structure in an alternate embodiment of the invention.
Figure 6:
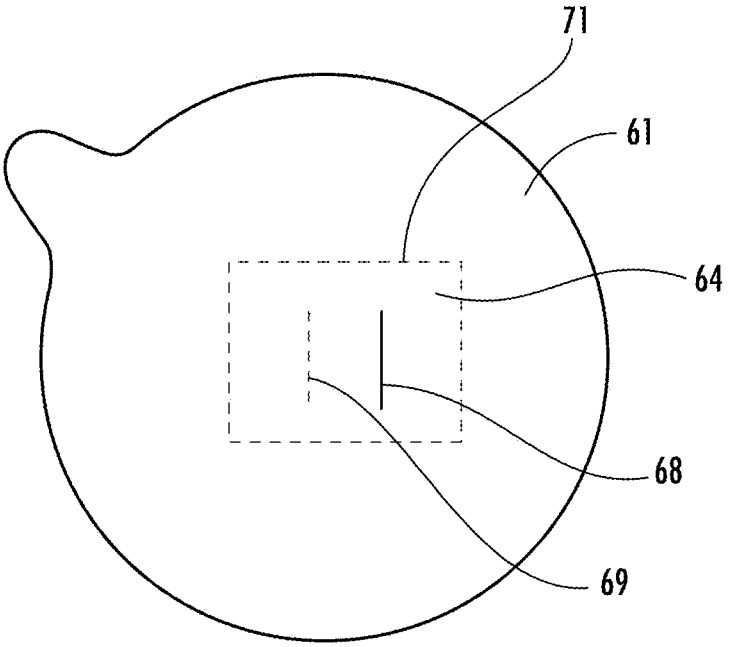
FIG. 6 is a top view of an embodiment of a membrane with an one-way valve which can be adhered to the container of the invention.
Figure 7A:
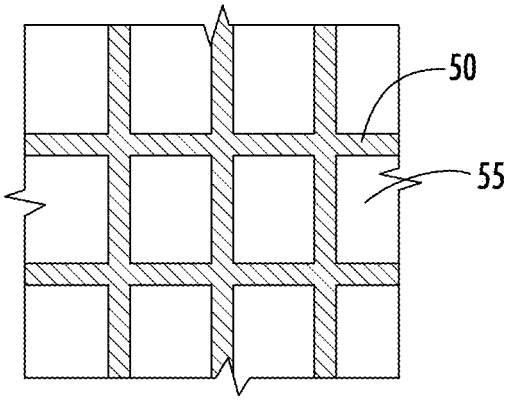
FIG. 7A-7D are examples of certain adhesive patterns that can be utilized between the container sidewall and the liner ply in certain embodiments.
Figure 7B:
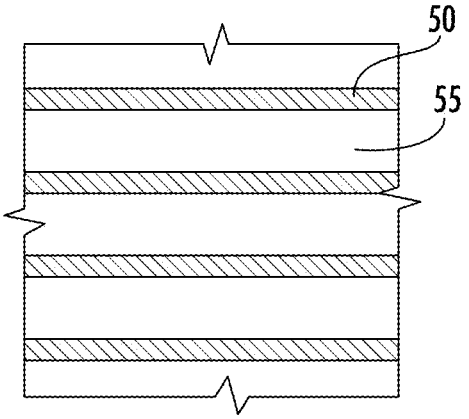
Figure 7C:
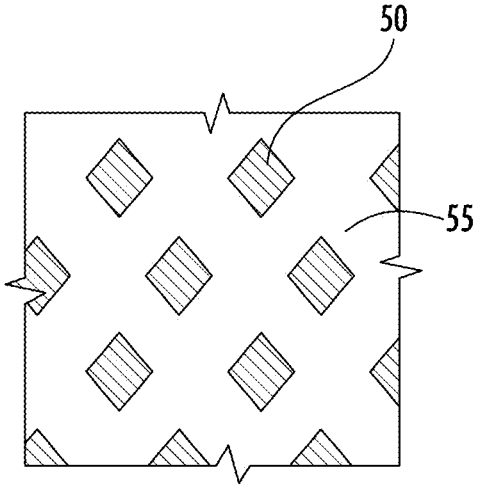
Figure 7D:
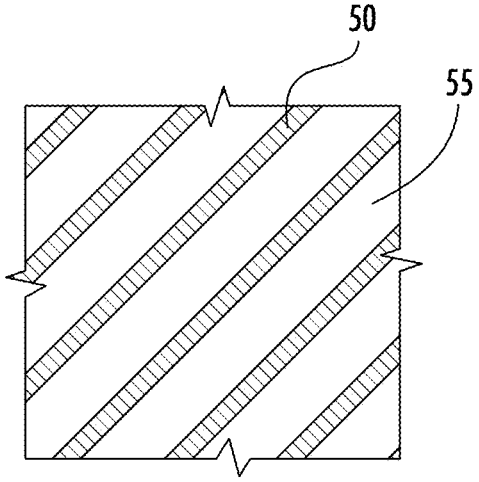

FIG. 6 shows a top view of the membrane 61 and valve 64 and FIGS. 5A-5C show an exploded cross-sectional view of the membrane 61 and the valve 64, in various configurations and embodiments. Membrane structure 61 may comprise a first film layer 65 and a second film layer 66. The second film layer 66 may be laminated to the first film layer via a permanent adhesive 67 which may, in an embodiment, be pattern-applied to at least one of the first 65 or second 66 film layers. In another embodiment, the permanent adhesive may be flood-coated over one or more of the layers and then deadened to create an area which is not adhered.

The first film layer 65 may form the outer layer of the membrane 61, whereas the second film layer 66 may form the inner layer of the membrane 61, and is thus underneath the first film layer 65. The first film layer 65 may include a first cut line 68, and the second film layer 66 may include a second cut line 69, which is offset from the first cut line 68 (e.g., is spaced apart from the first cut line). While the cut lines 68, 69 are shown in the figures as straight lines, it should be understood that the cut lines can have any shape or configuration known in the art. For example, the cut lines 68, 69 may be curved, v-shaped, or u-shaped. The cut lines 68, 69 may be semi-circular, in an embodiment. In an embodiment, the cut lines are aligned vertically or horizontally. In an embodiment, the cut lines are symmetrical. In other embodiments, the bottom cut line (on the layer closest to the interior of the container 10) is larger than the top cut line.

A cross-section of an embodiment of the valve 64 is shown in FIG. 5A, in a closed position, and in FIG. 5B, in an open position. With reference to FIGS. 5A and 5B, the valve 64 includes the first and second cut lines 68, 69, such that the first and second cut lines are contained within a perimeter 71 of the valve 64 (shown in FIG. 6). The valve 64 may, for example be an area of the membrane 61 that is devoid of the permanent adhesive 67 adhering the first and second film layers 65, 66 to each other. In this way, the perimeter 71 of the valve 64 may be the interface between an area including permanent adhesive 67 and an area devoid of permanent adhesive. The perimeter 71 of the valve 64 is illustrated as a rectangular shape, but it should be understood that the valve 64 can be any shape known in the art. For example, the perimeter of the valve can be triangular, circular, ovular, or any other shape known in the art.

The valve 64 may, in an embodiment, comprise a viscous medium, such as oil 72, that is pattern-applied to at least one of the first or second film layers 65, 66 and is disposed between the first and second film layers so as to occupy at least a portion of the valve area. The oil 72 may, for example, be silicone oil in some cases. The presence of the oil 72 may encourage the opposing surfaces of the first and second film layers 65, 66 (e.g., the surface of each film layer that is adjacent to or most proximate the other film layer) to maintain contact with each other (with the oil disposed therebetween) by virtue of the viscosity and/or surface tension of the oil, such that the valve 64 is biased towards the closed position shown in FIG. 5A when the pressure inside the package is below a certain threshold pressure. For example, in some embodiments, the volume of oil 72 disposed between the first and second film layers 65, 66 is selected such that the valve opens when the pressure inside the container 10 just exceeds the atmospheric pressure outside the package. An example of a desirable range of pressures inside the package for moving the first layer 65 towards the open position shown in FIG. 5B is approximately 0.1 psi to approximately 0.8 psi.

The valve 64 opens, as shown in FIG. 5B, when a gas begins to move from the interior of the container 10 through the second cut line 69, as shown by the arrows. The gas pushes the first film layer 65 slightly upwardly, in some embodiments, and continues to travel through the valve area (through the oil 72, if present) toward the first cut line 68. The gas then passes through the first cut line 68, shown by the arrow in FIG. 5B, and is dispelled into the atmosphere.

In addition, when the atmospheric pressure outside the package is slightly above the pressure inside the package, the valve 64 is configured to move from the open position shown in FIG. 5B to the closed position shown in FIG. 5A, so as to seal the valve 64 closed and prevent gas and/or moisture from entering the package. In some embodiments, the valve 64 is configured such that a desirable range of atmospheric pressures outside the package for moving the first layer 65 towards the closed position shown in FIG. 5A is approximately 0.05 psi to approximately 0.5 psi, but in any case is less than the pressure required inside the container 10 to open the valve 64.

In some embodiments, an opposing surface of at least one of the first or second film layers 65, 66 may further include a surface treatment 73 configured to decrease an amount of surface energy between the first and second film layers 65, 66 in the valve area 64. The surface energy may be characterized as the amount of energy required to adhere the opposing surfaces of the first and second film layers 65, 66 to each other. Thus, while the addition of the oil 72 in the valve 64 between the opposing surfaces of the first and second film layers 65, 66 serves to increase the surface energy of the interface between the opposing film surfaces, the resulting surface energy may be too great to allow the valve 64 to open (FIG. 5B) at the desired pressure level of the package interior. The inclusion of the surface treatment 73 for at least one of the opposing surfaces of the first and second film layers 65, 66, however, may counteract the increased adhesion force imparted by the oil 72, thereby reducing the surface energy to a level that allows the valve to be moved from the closed configuration shown in FIG. 5A to the open configuration shown in FIG. 5B when a desired level of pressure is achieved within the package.

In some embodiments, for example, the surface treatment 73 may comprise at least one of a printed ink, a coating, or a texture that is applied to one or both of the opposing surfaces of the first and second film layers 65, 66. The surface treatment (e.g., the printed ink, coating, or texture) may serve to create bumps or ridges that extend from the surface of the respective film layer 65, 66 that is treated toward the opposing surface of the other film layer. In the depicted example of FIGS. 5A and 5B, for example, the surface treatment 73 has been applied to the inner surface of the first film layer 65, such that the ridges extend from the first film layer 65 towards the second film layer 66. Accordingly, the surface energy of the interface between the first and second film layers 65, 66 may be decreased due to the reduced contact area between the two film layers. For example, instead of substantially the entire opposing surface of the first film layer 65 in the valve 64 contacting substantially the entire opposing surface of the second film layer 66 in the valve 64, in which case the surface energy would be at a maximum, the ridges created by the surface treatment 73 in some embodiments may reduce the contact area to the sum of the areas over which each of the ridges contacts the corresponding locations of the opposing surface of the respective film layer. The type of surface treatment, the number of ridges created, and/or the amount of inherent separation between the first and second film layers 65, 66 caused by the extension of the ridges may be selected to achieve a desired surface energy that results in the opening of the valve at the desired package pressure. In addition, the pattern of the ridges may be selected to further tune the opening and closure of the valve, depending on the requirements of the package. In some cases, the thickness of the surface treatment (e.g., thickness of the coating used), the roughness imparted by the surface treatment (e.g., based on the chemical makeup of the surface treatment), and the location of the surface treatment may also affect the resulting surface energy.

In the depicted embodiments of FIGS. 5A and 5B, the surface treatment 73 of the first or second film layers is located only in the valve area 64. However, in other embodiments, the surface treatment may extend outside the valve area 64. For example, in some cases, the surface treatment may extend along the entire film, or the surface treatment may be applied to an area that is larger than the valve area 64. In this way, alignment of the valve area with the location of the surface treatment during lamination of the film layers 65, 66 may be easier to achieve, such as during the manufacturing process.

Likewise, in an embodiment, rather than utilizing a surface treatment, particles may be present within the valve structure, optionally within the oil 72. The particles may create a separation between the first and second film layers 65, 66 and/or decrease the surface energy of the interface between the first and second film layers 65, 66.

The flexible laminate structure may include first and second film layers 65, 66 made of various different materials, depending on the particular application (e.g., depending on the type of product stored in the package). The first and/or second film layers 65, 66 may, for example, include a polymer. In some embodiments, for example, one of the first or second film layers 65, 66 may comprise polyethylene terephthalate (PET). In other embodiments, one of the first or second film layers 65, 66 may include oriented polypropylene (OPP). Other materials that may be used for the first or second film layers 65, 66 may include polyethylene (PE), metal foil (e.g., aluminum), metallized oriented polypropylene (mOPP), metallized polyethylene terephthalate (mPET), and co-polymer polypropylene (CPP), to name a few. Accordingly, typical laminate structures may include, for example, PET/Foil/PE, PET/Foil/PET/PE, PET/mPET/PE, PET/mOPP/PE, OPP/mOPP/PE, PET/PE, OPP/PE, OPP/OPP, OPP, mOPP, PET/CPP, and PET/Foil/CPP.

In this regard, in some cases, the flexible laminate structure described above may be made using a first or second film layer 65, 66 (or both) that includes two or more sub-layers, as shown in FIG. 5C. One or both of the first and second film layers 65, 66 may, for example, be a 2-ply film, a 3-ply film, a 4-ply film, or include additional plies, depending on the particular application (e.g., depending on the type of product to be stored in the package), with some example structures as noted above. In FIG. 5C, for example, a flexible laminate structure showing the integrated valve in a closed configuration is illustrated that has a single-ply first film layer 65 and a 3-ply second film layer 66. Sub-layers having different characteristics (e.g., different thicknesses, different materials, etc.) may be used in some cases to achieve certain oxygen and/or moisture transmission rates, so as to promote the freshness and/or shelf life of the product stored in the package. For example, the first film layer 65 may be a single-ply layer of PET, whereas the second film layer 66 may be a 3-ply film with sub-layers of foil/PET/PE.

In an embodiment, if the container 10 is transported from a higher altitude to a lower altitude, the internal pressure within the container 10 may be greater than atmospheric pressure, creating greater pressure on the interior of the container 10 than is present outside the container 10 (positive pressure). The one-way valve may allow release of the interior pressure without compromising the hermetic seal of the container 10, reducing or eliminating heat seal failures and outward container 10 or bottom end 14 distortion (i.e. distended sidewalls, bottom walls, etc.).

In an embodiment, a removable overcap 63 is disposed over the membrane seal 61. In another embodiment, the top end closure comprises an overcap 63 without a flexible membrane. In an embodiment, the overcap 63 is configured to snap-fit onto the rolled rim 32 of the container sidewall 12. The overcap may be made of paper, plastic, metal, foil, any combination thereof, or any other material(s) known in the art. The overcap 63 may comprise a barrier treatment and/or barrier layer. In an embodiment, the overcap 63 is configured to seal closed the opening 30 of the container 10 and/or enclose the interior of the container. In an embodiment, the overcap 63 is removable and replaceable. In an embodiment, the overcap 63 may be porous or breathable to allow for off gassing via the valve 64. In another embodiment, the overcap 63 may have a larger inner dimension to provide space for released gas via the valve 64.

Regardless of the shape of the container 10, the overcap 63 is designed to snugly fit over the edge 32 of the container sidewall 12 to enclose the container contents. In an embodiment, if the container 10 is cylindrical, the overcap 63 is generally circular or disk-shaped and conforms to the dimensions of the container 10.

The bottom end closure 62 of the tubular container 10 may be constructed of metal, paper, plastic, or any other material known in the art. The bottom end closure 62 may be heat sealed onto the container body.

In an embodiment, one or more tamper evidence features may be presented within the container structure. Many tamper evidence features are known in the art and are encompassed within the invention.

As an advantage to the invention, if/when a vacuum is created within the container 10 (negative pressure), the flexible nature of the liner ply 17 allows it to separate from the body ply 13 and move inwardly against the food products 22, equalizing the pressure on the inside and outside of the container 10. As the liner ply 17 moves inwardly, a space 82 may develop between the liner ply 17 and the body ply 13. In an embodiment, the container sidewall 12 comprises a relatively porous paperboard construction, which allows for a sufficient migration of air to travel therethrough such that the space 82 between the liner ply 17 and the body ply 13 remains at atmospheric or ambient pressure. Thus, the container sidewall 12 is not subjected to negative pressure over an extended period, which could cause the container 10 to collapse.

In an embodiment, the container 10 of the invention is hermetically sealed, preventing the ingress or egress of gases, liquids, or other particles, until the container 10 is opened by a consumer. When the container 10 is opened by the consumer, such as by removing the flexible membrane 61, any existing vacuum may be released and the liner ply 17 may withdraw at least partially from the food products 22 and toward the container sidewall. This withdrawal of the liner ply 17 may aid in removal of the food products 22 from the container 10.

The container 10 of the present invention provides numerous advantages. The container 10 also provides a product which is fully recyclable. The liner ply 17 can be removed from the container 10 after use and can be recycled as a plastic. The container 10 can be recycled as paper. The overcap 63 can be recycled as paper or plastic, depending on its construction. The use of a barrier material or barrier layer within the container 10 can be eliminated due to the presence of the liner ply 17, saving manufacturing time, costs, and resources. Further, the food product 22 contained within the inventive container 10 is better protected from breakage and damage due to the cushioning provided by the liner ply 17. Still further, the container 10 is better adaptable to changes in atmospheric and/or processing conditions which alter pressure on the interior or exterior of the container 10, as described herein. The inventive container 10 avoids or reduces implosion, heat seal failures and/or externally extended paper bottoms.

Method of Manufacture

The container 10 of the present invention may be manufactured according to the following process. A continuous strip of paperboard body ply material 13 is advanced through an adhesive applicator which applies an adhesive to the inner surface of the body ply. The adhesive applicator can be a standard roller type applicator that applies adhesive to the entire inner surface of the body ply 13, in one embodiment, or can be a pattern applicator, in another embodiment.

The body ply 13 and adhesive layer 19 applied thereto may then be passed underneath a heater which evaporates at least part of the water content of the adhesive to render the adhesive substantially tacky. After heating the adhesive layer 19 on the body ply 13, the body ply 13 and the liner ply 17 are fed to a shaping mandrel from opposite directions. The body ply 13 is passed under a skive adhesive applicator which applies the skive adhesive to the beveled surface of the skived second edge of the body ply 13. The surface of the liner ply 17 that contacts the body ply 13 may be subjected to a corona treatment station. The opposite surface of liner ply 17 may be coated with lubricant from a roller 64, which allows the liner ply to slide smoothly during the winding operation. The body ply 13 and the liner ply 17 are then wrapped around the shaping mandrel from opposite sides of the mandrel. Each ply is first wrapped under the mandrel and then back over the top in a helical fashion with the liner ply 17 wound against the surface of the mandrel, forming a tube.

The tube is then advanced down the mandrel by a winding belt. Optionally, an outer label ply 15 is passed over an adhesive applicator and wrapped around the body ply 13. The label ply 15 could alternatively be applied before the winding belt. At a cutting station, the continuous tube is cut into discrete lengths before being removed from the mandrel.

In an embodiment, the end closures are then attached to the ends of the tube. At least one of the ends of the container 10 is rolled outwardly to form a rim 32 which provides a suitable surface for affixing the membrane 61. Another end closure, such as a paper closure, is attached to the other end of the container 10. In another embodiment, the paper end closure is applied to one end of the container 10 prior to filling of the container with the food products 22.

Methods of manufacturing a membrane 61 including an integrated one-way valve feature are also provided. According to embodiments of the methods, a first film layer 65 may be laminated to a second film layer 66 via a pattern-printed permanent adhesive 50 that is applied to at least one of the first or second film layers 65, 66, as described above. A first cut line 68 may be defined in the first film layer, and a second cut line 69 may be defined in the second film layer 66, where the first and second cut lines are offset with respect to each other. The cut lines 68, 69 may be defined in the flexible laminate after the first 65 and second 66 film layers have been laminated to each other, such as by using precision scoring techniques. Alternatively, a separately-formed valve 64 may be attached to the flexible laminate at a predefined location.

The first and/or second cut lines 68, 69 may be made in various ways, such as via a laser. As an alternative to the use of lasers for scoring the laminate, the cut lines 68, 69 can be formed in the laminate by mechanical scoring or cutting. For instance, a kiss roll and a backing roll may be used to form a nip through which the laminate is passed. The kiss roll may comprise a rotary cutting die defining a cutting edge that is configured to define the first and/or second cut lines 68, 69.

As the first and second film layers 65, 66 are laminated to each other, an area of the laminate may be left devoid of the permanent adhesive (or deadened if adhesive has been applied) so as to define the valve area 64. As described above, the first and second cut lines 68, 69 are defined within the valve area, such that the valve area includes the first and second cut lines. In addition, oil 72 may be pattern-applied to at least one of the first or second film layers 65, 66 in the area of the laminate devoid of the permanent adhesive. A surface treatment 73 may be effected, or particles may be disposed, with respect to at least one of the first or second film layers 65, 66, and the surface treatment or particles may be configured to decrease an amount of surface energy between the first and second film layers in the valve area, as described above.

In some cases, effecting a surface treatment 73 with respect to at least one of the first or second film layers 65, 66 may comprise using at least one of a printed ink, a coating, or a texture, such as to form ridges or bumps between opposing surfaces of the first and second film layers. The surface treatment may be effected with respect to at least one of the first or second film layers 65, 66 only in the valve area in some embodiments, whereas in other embodiments the surface treatment may extend outside of the valve area, such as in cases were the surface treatment is effected with respect to substantially the entire opposing surface of a respective film layer.

As described above, the first and second film layers 65, 66 may comprise different materials, such as PET, OPP, or other polymer materials, as well as non-polymer material such as aluminum foil. Moreover, at least one of the first or second film layers 65, 66 may comprise two or more sub-layers, such as in the example depicted in FIG. 5C.

After filling the container 10 with food products 22, the formed membrane 61 may be applied to the end of the tubular body. Thus, the present invention provides a method of manufacturing a composite container 10 having an at least partially detachable liner 17 and one-way valve 64 that overcomes the disadvantages of conventional methods and containers.

The container 10 of the present invention is particularly advantageous for packaging food products 22 having an elevated temperature, which upon cooling naturally create a negative pressure inside the sealed container or food products 22, regardless of whether that container will be transported from higher elevations to lower elevations or vice versa. The negative internal pressure can be alleviated due to the liner ply 17 construction.

The method of the present invention allows the liner ply 17 to partially or substantially release from the body ply 13 and move inwardly toward the food products to alleviate any negative pressure. The body ply 13 allows air to travel to the space created between the liner ply and the body ply, such that the pressures on each side of the liner ply 17 are balanced. The new container 10 is easy to manufacture, yet is capable of withstanding a rigid shape under changing atmospheric conditions and providing a hermetic seal to prevent air and moisture from contaminating the products contained therein.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products. It should be understood that any stackable product which can be stored and dispensed can also be packaged by the in the inventive container. Although specific terms are employed herein, they are used in a generic and descriptive sense only and not for purposes of limitation.

What is claimed is:

1. A container comprising:

a base;

at least one sidewall extending upwardly from the base and terminating in a top edge, wherein the at least one sidewall is paper based;

a removable flexible membrane adhered to the top edge, wherein the membrane comprises a one-way valve; and a liner ply adhered to an interior surface of the sidewall with a releasable adhesive, wherein the liner ply is configured to at least partially release from the sidewall upon a first pressure differential between the pressure within the container and an external pressure and wherein the adhesive has 100% coverage between the liner ply and the at least one sidewall.

2. The container of claim 1, wherein the first pressure differential comprises an internal pressure within the container which is less than atmospheric pressure.

3. The container of claim 1, wherein the adhesive is resealable and configured to allow readherence of the liner ply to the container sidewall upon a second pressure differential between the pressure within the container and an external pressure.

4. The container of claim 3, wherein the second pressure differential comprises an internal pressure within the container which is greater than atmospheric pressure.

5. The container of claim 3, wherein the liner ply may repeatedly release from and reseal to the container sidewall as pressure differentials occur.

6. The container of claim 1, wherein the pressure differential comprises between about 4 inches mercury and about 10 inches mercury.

7. The container of claim 1, wherein the adhesive maintains its adhesion along the container sidewall nearest the base and top edge, regardless of pressure differential.

8. The container of claim 1, wherein the adhesive is corn starch-based, dextrin-based, or is a pressure sensitive adhesive.

9. The container of claim 1, wherein the container is rigid.

10. The container of claim 1, wherein the liner ply comprises a polymeric material having barrier properties.

11. The container of claim 1, wherein the one-way valve is integrally formed with the top membrane.

12. The container of claim 1, wherein the one-way valve is externally applied to the top membrane.

13. A container comprising:

a base;

at least one sidewall extending upwardly from the base and terminating in a top edge, wherein the at least one sidewall is paper based;

a removable flexible membrane adhered to the top edge, wherein the membrane comprises a one-way valve; and a liner ply attached to the base and a top edge of the sidewall, wherein the liner ply is adhered to an interior surface of the sidewall with a releasable adhesive, wherein the adhesive has 100% coverage between the liner ply and the at least one sidewall, wherein the liner ply is configured to at least partially release from the sidewall between the base and the top edge, upon a pressure differential between the pressure within the container and an external pressure, and wherein the adhesive maintains its adhesion along the container sidewall nearest the base and top edge, regardless of pressure differential.

14. The container of claim 13, wherein at least 50% of the liner ply releases from the sidewall.

15. The container of claim 13, wherein at least 75% of the liner ply releases from the sidewall.

16. The container of claim 13, wherein the adhesive is corn starch-based, dextrin-based or is a pressure sensitive adhesive.

17. A container comprising:

a base;

at least one sidewall extending upwardly from the base and terminating in a top edge, wherein the at least one sidewall is paper based;

a removable flexible membrane adhered to the top edge, wherein the membrane comprises a one-way valve; and a liner ply attached to an interior surface of the sidewall, wherein the liner ply is at adhered to an interior surface of the sidewall with a releasable adhesive, wherein the adhesive has 100% coverage between the liner ply and the at least one sidewall, wherein the liner ply is configured to at least partially release from a midsection of the interior surface between the base and the top edge, upon a pressure differential between the pressure within the container and an external pressure.

18. The container of claim 17, wherein the liner ply may repeatedly release from and reseal from the midsection of the interior surface of the sidewall as pressure differentials occur.

* * * * *